US006817135B1

(12) United States Patent
Jackson

(10) Patent No.: US 6,817,135 B1
(45) Date of Patent: Nov. 16, 2004

(54) SHOTGUN SHELL CARRIER

(76) Inventor: Jonathan D. Jackson, 715 10th St., Lewiston, ID (US) 83501

( * ) Notice: Subject to any disclaimer, the term of this patent is extended or adjusted under 35 U.S.C. 154(b) by 0 days.

(21) Appl. No.: 10/628,422

(22) Filed: Jul. 29, 2003

(51) Int. Cl.[7] ..... F41A 9/61

(52) U.S. Cl. ..... 42/87; 42/88; 42/90; 89/34; 206/3; 224/931; 221/289; 221/310; 221/185

(58) Field of Search ..... 42/87, 88, 90; 89/34; 206/3; 224/931; 221/289, 310, 185

(56) References Cited

U.S. PATENT DOCUMENTS

| | | | | | |
|---|---|---|---|---|---|
| 162,481 | A | | 4/1875 | Lee | |
| 574,531 | A | * | 1/1897 | Ferguson | 221/289 |
| 2,503,741 | A | | 5/1950 | Johnson | |
| 2,779,522 | A | * | 1/1957 | Puckett | 221/185 |
| 2,789,727 | A | * | 4/1957 | Singleton | 221/124 |
| 2,837,258 | A | * | 6/1958 | Williams | 221/289 |
| 3,105,611 | A | * | 10/1963 | Conti | 221/248 |
| 3,219,244 | A | * | 11/1965 | Blask | 221/310 |
| 3,248,007 | A | * | 4/1966 | Hulterstrum | 221/116 |
| 3,283,954 | A | * | 11/1966 | Spooner | 221/232 |
| 4,381,845 | A | * | 5/1983 | Feis | 221/185 |

* cited by examiner

*Primary Examiner*—Jack Keith
*Assistant Examiner*—M. Thomson
(74) *Attorney, Agent, or Firm*—Richard C. Litman

(57) ABSTRACT

The improved shotgun shell carrier is a rectangular plastic housing one end closed by a sliding door. A zigzag-type compression spring is positioned within the housing between the sliding door and a magazine follower. The open end of the housing is provided with opposing feeding lips formed from spring steel and shaped to funnel the shells one at a time to a release point adjacent the tip of the feeding lips. The feeding lips are formed with a centrally located finger slot having a length greater than the width of a shotgun shell. Blocking elements are pivotally positioned at the open end of the housing to prevent extra shells from falling out when the feeding lips are open. The housing is adapted for receiving attaching elements to enable attaching the carrier to high-speed modular gear in a desired position for quick and efficient reloading of a shotgun.

20 Claims, 8 Drawing Sheets

SHOTGUN SHELL CARRIER

BACKGROUND OF THE INVENTION

1. Field of the Invention

The present invention relates to a dispenser specifically adapted for mounting at a user selected location on a user's body or gear, and for dispensing shotgun shells in a manner that facilitates increased speed and efficiency in the manual reloading of a shotgun.

2. Description of the Related Art

Carriers for dispensing ammunition shells and cartridges in positions to facilitate rapid reloading of weapons are well known. For example, U.S. Pat. No. 162,481 issued Apr. 27, 1875 to Lee shows a box designed to enclose a single row of cartridges. With the use of a follower and zigzag spring the cartridges are forced towards the opening of the box where they are dispensed. A pair of straps is provided so that the carrier can be worn on the body so that the opening of the box is positioned near the waist of the wearer to facilitate rapid reloading of a weapon. In use, the lower-most cartridge, which is held in the box under the pressure of the spring, is grasped by one end and pulled out of the box via the opening.

In addition, U.S. Pat. No. 2,503,741, issued Apr. 11, 1950 to Johnson teaches a waist worn device for dispensing ammunition. The Johnson device is in the form of a container that carries two stacks of cartridges that are funneled by the shape of the container into a discharge chute, wherein one small end portion of the bottom-most cartridge is exposed out of an opening in the container. A spring-bias stop member precludes ejection of the bottom-most cartridge out through the container opening. The exposed end of the bottom-most cartridge must be grasped and pulled to overcome the stop member and remove the cartridge from the container. A bifurcated spring provides thrust to the top of each stack of cartridges to urge succeeding cartridges into the discharge chute.

Neither the Lee device nor Johnson device provides a rapid reload capability suitable for the present day needs of military and law enforcement personnel or for today's competitive shooters and hunters using shotguns. Neither the Lee device nor the Johnson device is adaptable for ready integration with the high-speed tactical modular gear ever-increasingly in use today by tactical military and law enforcement personnel.

None of the above inventions and patents, taken either singly or in combination, is seen to describe the instant invention as claimed. Thus an improved shotgun shell carrier solving the aforementioned problems is desired.

SUMMARY OF THE INVENTION

The present invention provides an improved shotgun shell carrier in the form of a rectangular plastic housing sized to receive from 5 to 25 shotgun shells. One end of the housing is closed by a sliding door. A zigzag-type compression spring is positioned within the housing between the sliding door and a magazine follower. The open end of the housing is provided with a pair of opposing feeding lips formed from spring steel and shaped to funnel the shells one at a time to a release point adjacent the distal end of the feeding lips. The feeding lips are formed with a centrally located finger slot having a length at least equal to the width of two shotgun shells. To prevent extra shells from falling out of the feeding lips when they are forced open as the bottom-most shell is grasped and removed, blocking elements are pivotally positioned at the open end of the housing. As the lower ends of the blocking elements are pivoted out the way during removal of the bottom-most shell, the upper ends of the blocking elements are pivoted into engagement with the shells near the opening of the housing to prevent extra shells from falling out when the feeding lips are open. The housing is additionally provided with protrusions spaced along both side surfaces of the housing, each having an attaching surface that is flush with the back surface of the container. An internally threaded metal insert in provided in each protrusion for receiving a threaded fastener, whereby the carrier can be conveniently attached to ones body gear or equipment in a desired position for quick and efficient reloading of a shotgun.

Accordingly, it is a principal object of the invention to provide an improved shotgun shell carrier that will enable more rounds of shotgun shells to be carried.

It is another object of the invention to provide a shotgun shell carrier that is readily adaptable as a modular accessory for high-speed tactical gear.

It is a further object of the invention to provide a shotgun shell carrier that can be positioned on the body in a place that shells can be quickly and easily removed for optimum efficiently in the reloading a shotgun.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
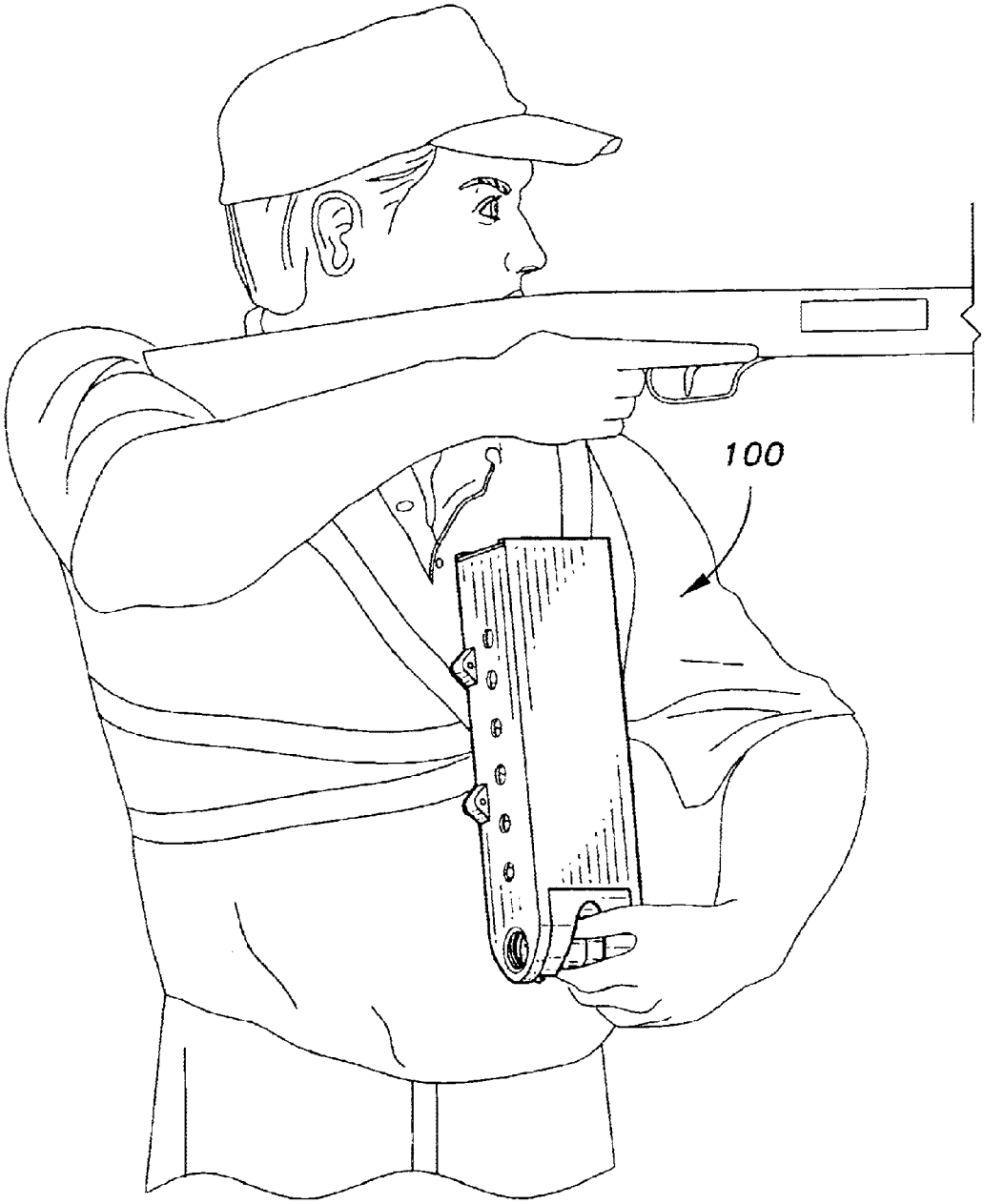
FIG. 1 is an environmental, perspective view of a shotgun shell carrier according to the present invention attached to the gear of a person and in position for rapid reloading of a shotgun.
Figure 2:
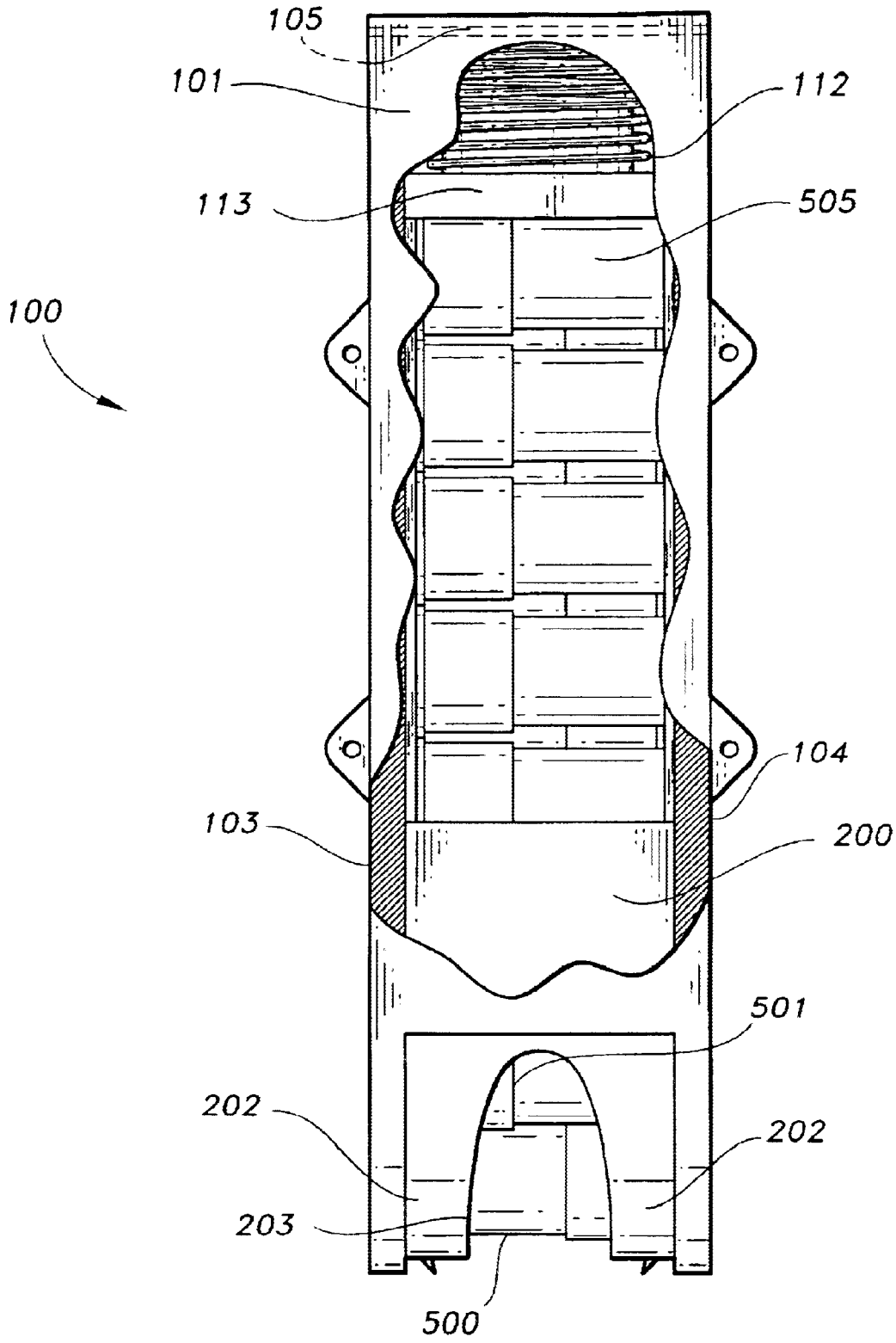
FIG. 2 is a front view of the improved shotgun shell carrier according to the present invention with a cut-away portion revealing interior detail of the loaded carrier.
Figure 3:
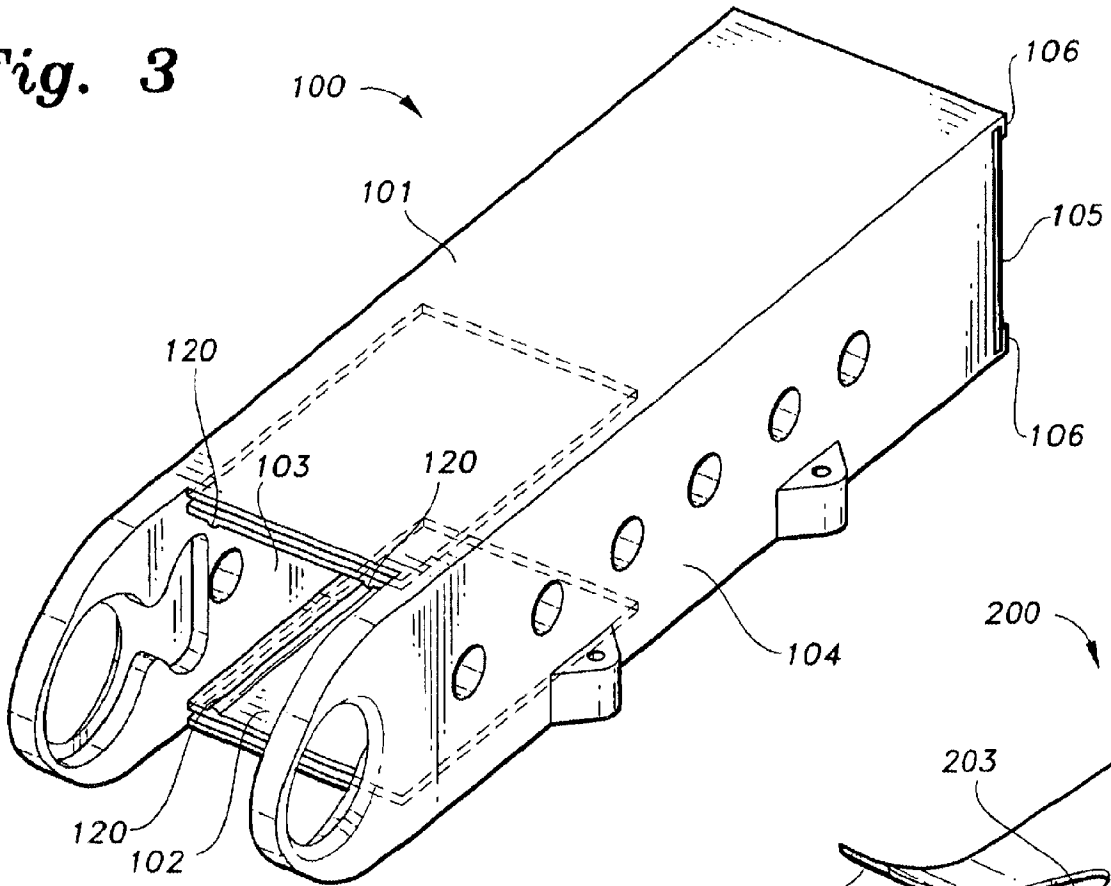
FIG. 3 is a perspective view of the housing of the shotgun shell carrier according to the present invention.

As best shown in FIGS. 1 and 3, the present invention provides a shotgun shell carrier in the form of a rectangular housing 100 that is sized to receive from 5 to 25 shotgun shells. The housing 100 is preferably fashioned of durable high-strength composite plastic materials and includes a front wall 101, back wall 102, left sidewall 103 and right sidewall 104. Each sidewall has an array of count openings arranged along the longitudinal extent of the sidewall to permit one to obtain a count of remaining ammunition by feel. One end of the housing 100 is provided with L-shaped rails 106. A sliding door 105 is operatively received within the rails 106 to close that end of the housing 100. A zigzag-type compression spring 112 made of high strength steel is positioned within the housing 100 between the sliding door 105 and a plastic magazine follower 113.

As best seen in FIG. 3, front wall 101 and back wall 102 are each provided with an elongated slot to receive the one of the spring plates 201 of opposing feeding lips 200. The interior surfaces of front wall 101 and back wall 102 are provided with longitudinal ribs 120 to accommodate the rims of the shotgun shells and prevent the shells from sticking to the housing in unfavorable weather conditions. Each sidewall 103, 104 further includes an extension that extends beyond the opening of the housing. The extensions include a beveled opening for guiding shotgun shells into the housing when loading the carrier. Each extension is shaped to cover and protect the side edges of the feeding lips 200 from damage. The beveled openings in the sidewalls enable one to quickly load the housing with shells from either the left or right hand side of the carrier. The internal surfaces of the sidewalls also have a longitudinal recess that extends from a point on the housing adjacent the opening of the housing to the distal end of each extension.

Figure 4:
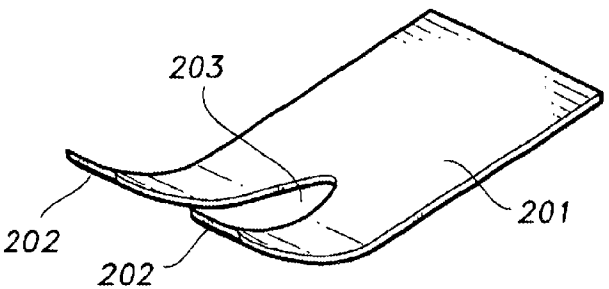
FIG. 4 is a perspective view of the retaining lips of the shotgun shell carrier according to the present invention.
Figure 5:
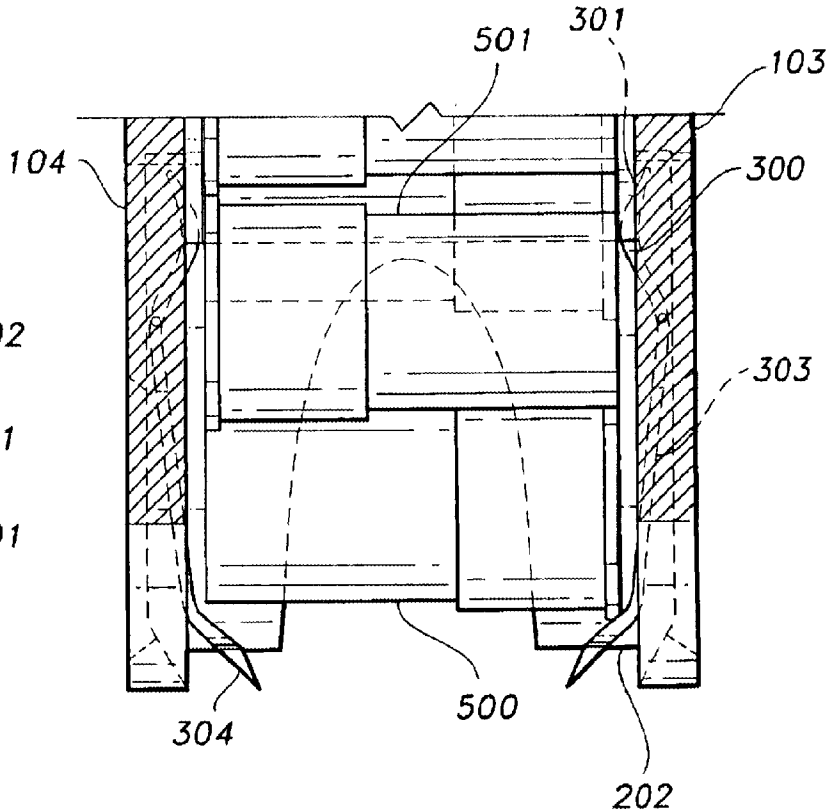
FIG. 5 is a cut-away view of the round releasing portion of the shotgun shell carrier as shown in FIG. 2.
Figure 6:
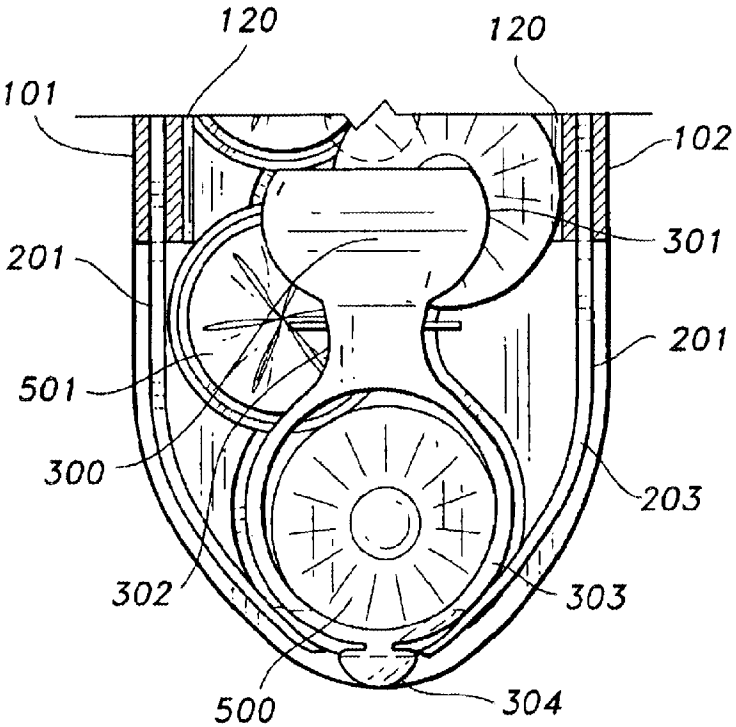
FIG. 6 is a cross-sectional view of the round releasing portion of the shotgun shell carrier taken along lines 6—6 of FIG. 5.

FIG. 4 shows that each feeding lip 200 has two curved spring fingers 202 separated by a finger slot 203. The spring portions 201 of the feeding lips are securely received in the elongated slots of front wall 101 and back wall 102 as shown in FIG. 5.

The opposing feeding lips 200 are formed from spring steel and shaped to funnel the shotgun shells one at a time to a release point adjacent the tip of the feeding lips 200. The centrally located finger slot 203 is formed with a length at least equal to the width of two shotgun shells to facilitate easy reloading of the housing 100 and rapid dispensing of shells 500, 501 from the lips.

To prevent extra shells from falling out of the feeding lips 200 when the bottom-most shell 500 is grasped and removed, blocking elements 300 are positioned within the recesses of the sidewalls and fixed by a pins for pivotal movement. In FIG. 5, blocking elements 300 are shown pivotally attached by pins in the recesses of the extensions to sidewalls 103 and 104 adjacent the open end of housing 100. Each blocking element 300 is formed of a rigid metal or plastic material having a paddle-like portion 301 formed at an upper end connected by a small neck portion 302 to a ring-shaped lower portion 303. Neck portion 302 is pivotally attached to the extension. A foot portion 304 is attached to the lower end of the ring-shaped lower portion 303 so as to be disposed in the path of movement of the lowermost shell 500 as it is being removed. The paddle-like portion 301 of the blocking element 300 is shaped so as to pivot into blocking engagement with the ends of the next shell 501 to prevent its movement when shell 500 is moved past foot portion 304 and feeding lips 200 are still in an open position. When the foot portions of the blocking elements 300 are moved during removal of the bottom-most shell 500, paddle-like portions 301 are pivoted into blocking engagement with the shells near the opening of the housing 100 to prevent extra shells from falling out when the feeding lips 200 are open.

To load the housing 100, shells are passed into the feeding lips 200 through the beveled opening in the extension and the ring-shaped lower portion 303 of the blocking element 300. The shells are pushed upward into the housing 100 using the elongated finger slots 203 in feeding lips while additional shells are feed through the ring-shaped lower portion 303 of the blocking element until the housing is fully loaded.

Figure 7:
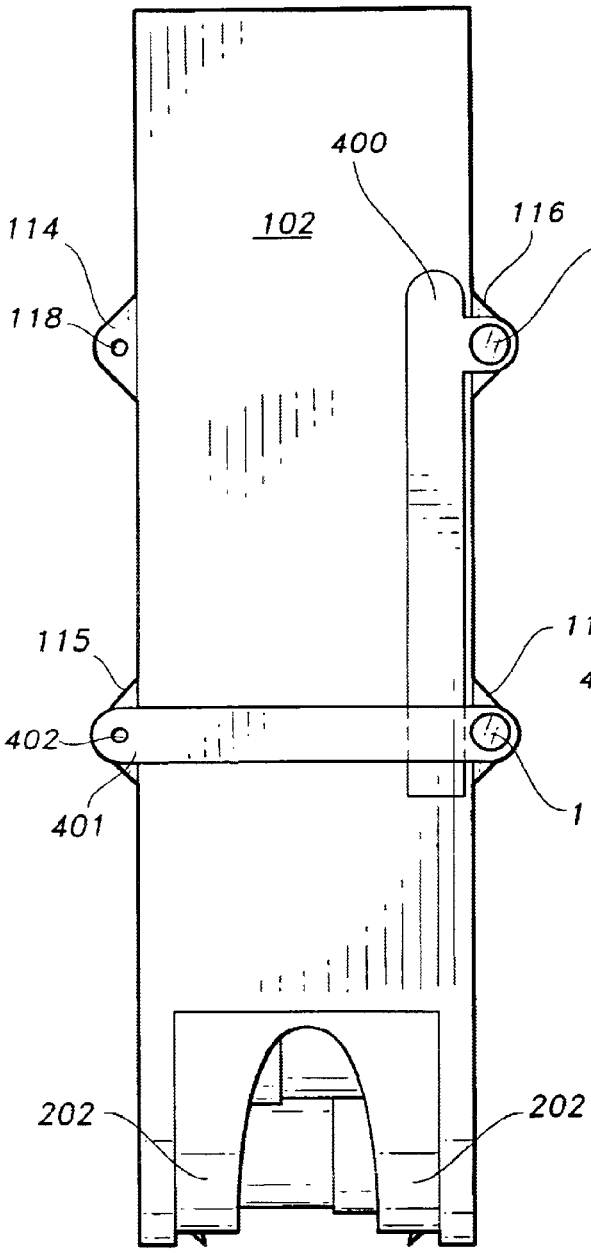
FIG. 7 is a rear view of the shotgun shell carrier housing according to the present invention.
Figure 8:
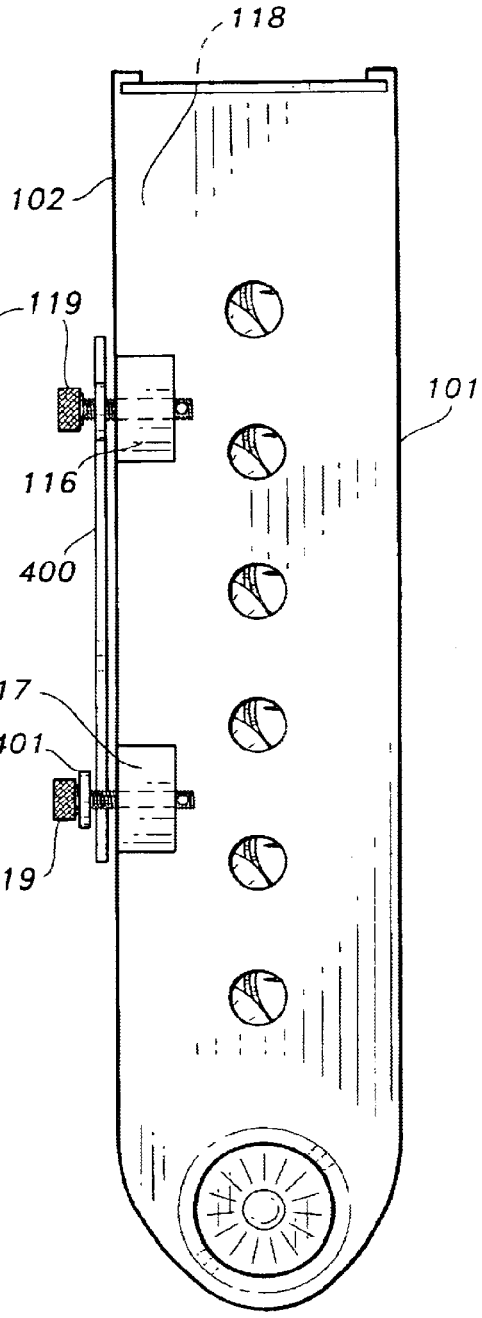
FIG. 8 is a side view of the shotgun shell carrier housing as shown in FIG. 7.

Referring now to FIGS. 7 and 8, the housing 100 is additionally provided with protrusions 114–117 spaced along both sidewalls 103, 104. Each protrusion includes an attaching surface that is flush with the back wall 102 of the housing 100. An internally threaded metal insert 118 is provided in each protrusion 114–117, perpendicular to the attaching surface for receiving a knurled bolt 119, 410.

To attach the housing to a conventional belt or strap, Marine Molle-type equipment and other compatible systems, flat rigid strips 400, 401 having apertures 402 for attaching the strips between vertically or horizontally aligned protrusions 114–117 as best seen in FIG. 7 are attached to the protrusions using knurled bolts 119. The strips are formed preferably from a durable material such as aluminum or plastic.

Figure 9:
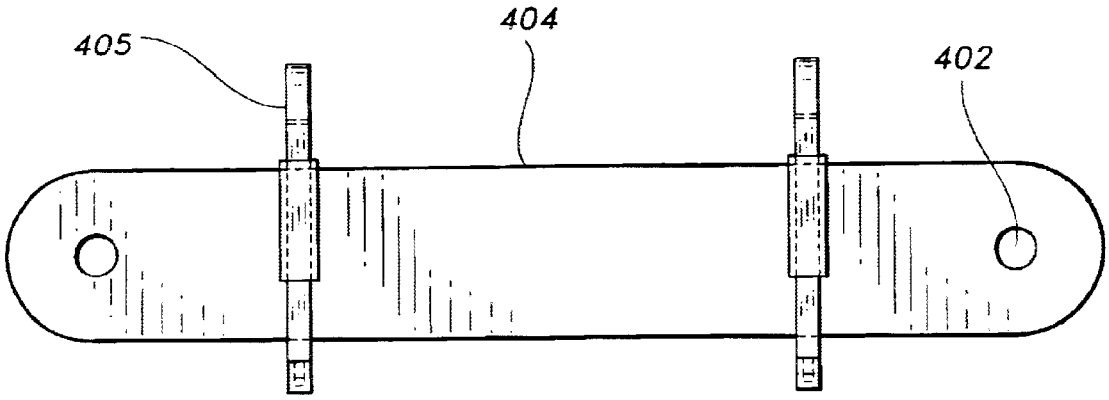
FIG. 9 is a front view of an attaching element having alice clips affixed thereto according to the present invention.

For systems that make use of clips, FIG. 9 shows rigid strips 404 are provided which have Alice clips 405 secured thereto. With the strips 404 affixed to the carrier 100 by knurled bolts 119, the carrier 100 may be conveniently attached to the gear using the clips.

Figure 10:
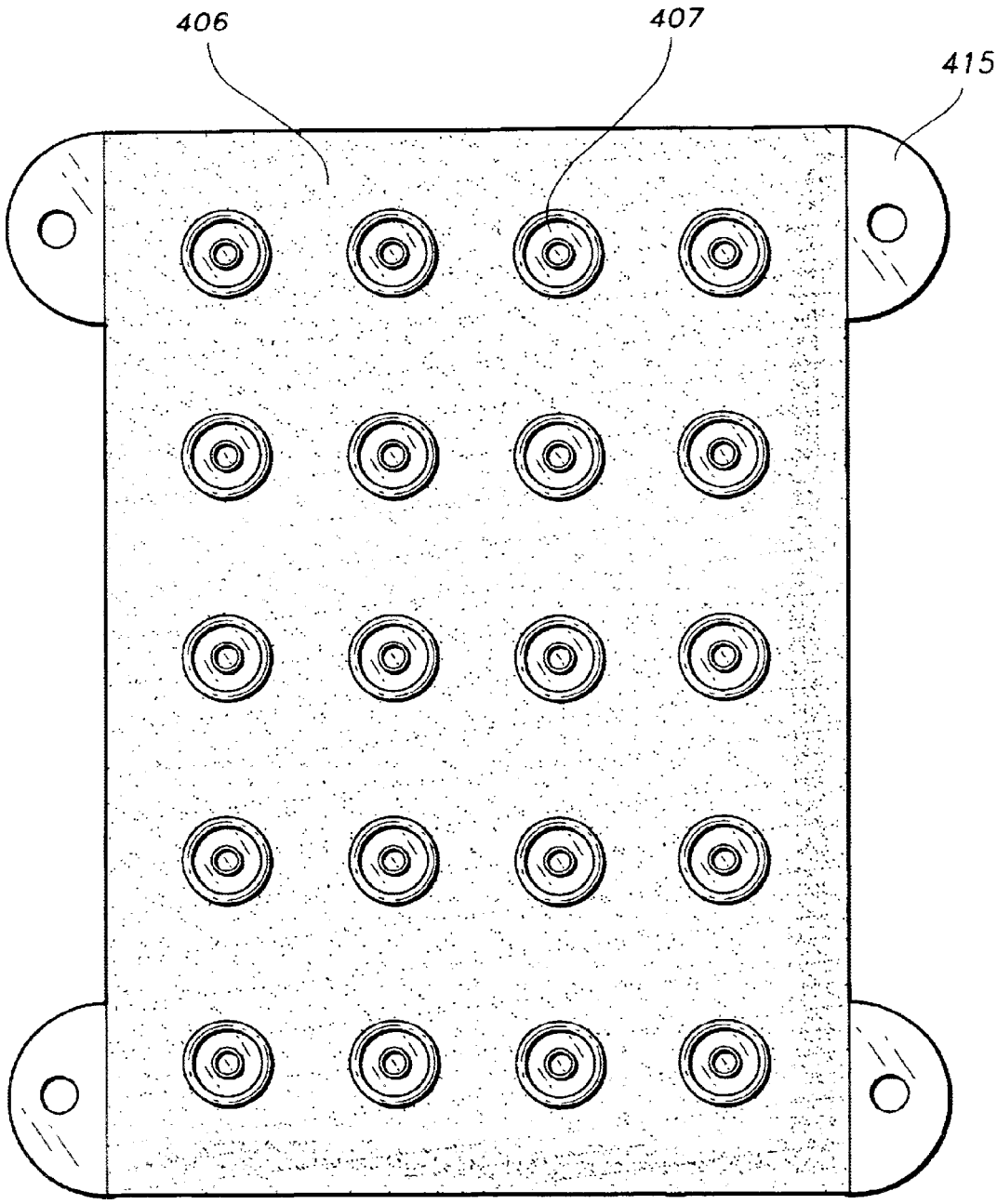
FIG. 10 is a front view of a Velcro panel with snap fastener attaching elements according to the present invention.

FIG. 10 shows an attaching device to be used with POINT BLANK™ style vests. A backing is provided with ears 415 having apertures for attaching the backing to the housing 100. The backing is further provided with a layer 406 of VELCRO™ material and a plurality of snap fasteners 407 suitably arranged on the backing for cooperating with fasteners on the vest to secure the carrier 100 to the vest as an accessory.

Figure 11:
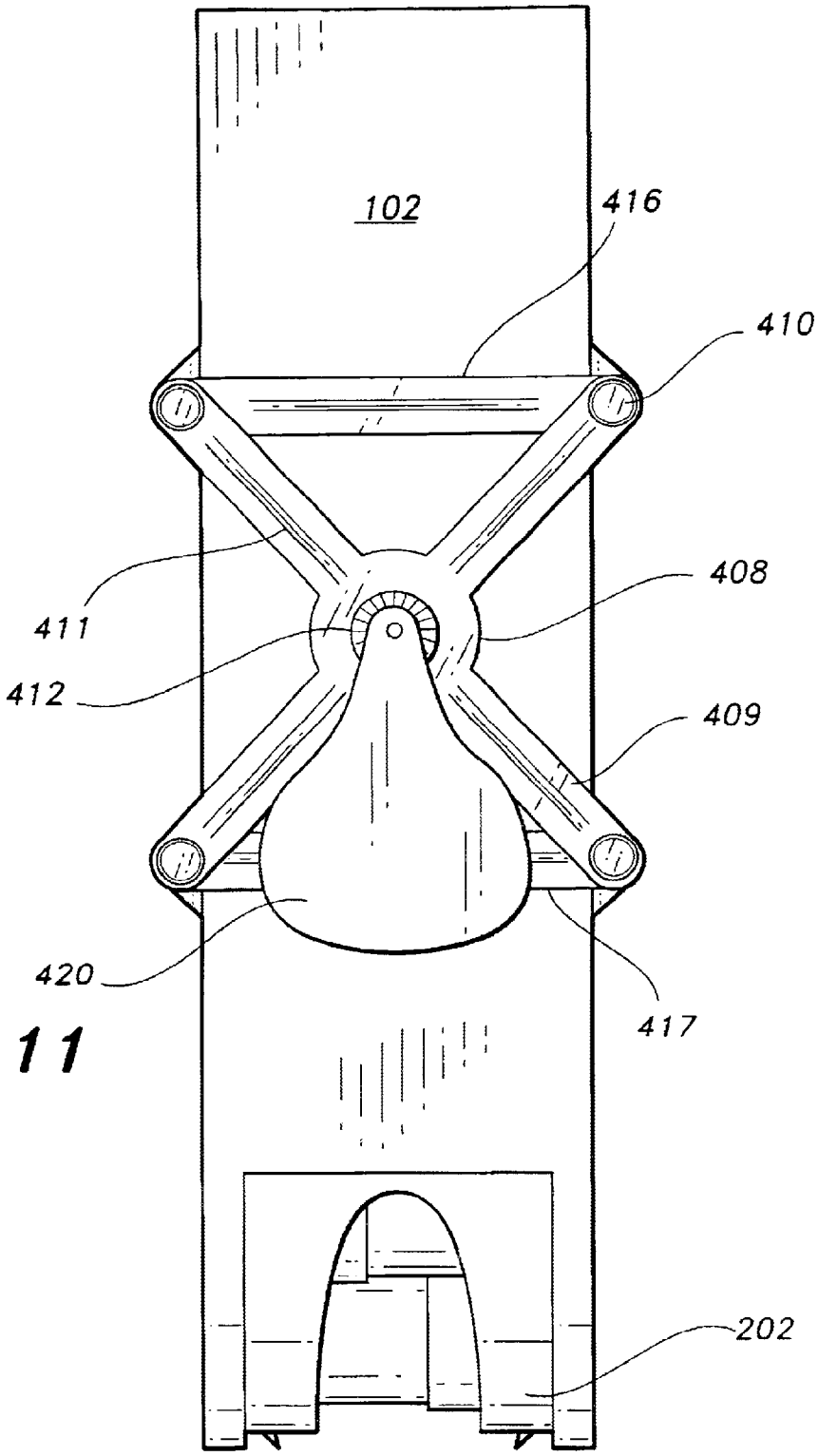
FIG. 11 is a rear view of the shotgun shell carrier housing according to the present invention, having a universal attaching element with a paddle element attached thereto.

A universal-mounting bracket 408 is provided to mount the carrier to any type of ballistic vest, load bearing vest or clothing (see FIG. 11). The bracket is formed from aluminum or plastic material and includes an X-shaped member with four arms 409 provided with strengthening ribs 411 and two cross-bars 416, 417 having strengthening ribs arranged in an hourglass configuration and attached to the housing 100 using knurled bolts 410. To adapt bracket 408 for use with a Folbus-like paddle 420 that is used in undercover or competitive use and worn on the belt, a circular array of ridges is provide around a center opening. The ridges cooperate with similar ridges around an opening on the back surface of a paddle 420 to adjustably position the paddle 420 at any angle relative to bracket 408 when the paddle 420 is secured to the bracket 408 by a bolt (not shown).

Figure 12:
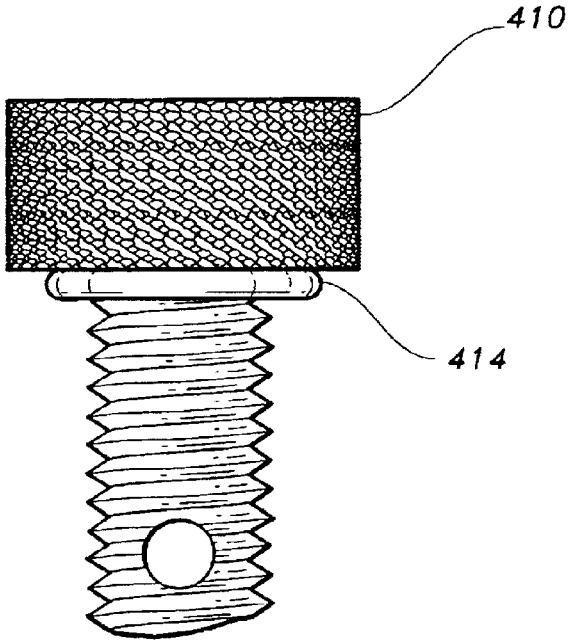
FIG. 12 is a side view of a knurled bolt having a rubber O-ring for securing the attaching elements to the housing of the shotgun shell carrier according to the present invention.

FIG. 12 depicts a knurled bolt 410. A plurality of bolts 410 is used to secure the attaching elements to the housing 100. Each bolt is provided with a rubber O-ring to lessen noise associated with the attachment between the housing 100 and the attaching elements. Bolts 119, 410 are preferably provided with an opening adjacent the ends of the bolt for receiving a cotter pin. With the attaching devices previously set forth above, the carrier is readily adaptable for attachment as a modular accessory to high-speed tactical gear in a position upon tactical gear for quick and efficient reloading of a shotgun and can be conveniently attached to ordinary body gear such as a belt.

It is to be understood that the present invention is not limited to the embodiment described above, but encompasses any and all embodiments within the scope of the following claims.

I claim:

1. A shotgun shell carrier, comprising:

a rectangular housing sized to receive between 5 and 25 shotgun rounds double stacked, said housing having a front wall, a back wall, two side walls, an open end and an end closed by a sliding door;

a spring structure positioned within said housing between said sliding door and a magazine follower;

an elongated slot formed within said housing adjacent said open end for receiving and securing a pair of opposing feeding lips in said open end of said housing;

each feeding lip having curved spring fingers separated by a finger slot and a flat portion for cooperating with said elongated slot for receiving and securing said pair of opposing feeding lips;

each side wall having an extension extending beyond said open end of said housing with an internal recess extending from a point adjacent said open end of said housing to a distal end of said sidewall, each extension further includes a beveled opening having a diameter slightly greater than a diameter of a shotgun shell;

a blocking member pivotally mounted within each said internal recess, said blocking member including a paddle portion, a neck portion and a ring-shaped portion having a diameter greater than a diameter of a shotgun shell, said ring-shaped portion having a foot positioned to interfere with movement of a shotgun shell from said feeding lips of said carrier, each blocking member being pivotally attached at said neck portion to an extension; and protrusions on said sidewalls for securing carrier attaching elements.

2. The shotgun shell carrier of claim 1, wherein said housing is made of a durable high-strength composite plastic material.

3. The shotgun shell carrier of claim 2, wherein said spring structure is a high-strength zigzag compression spring.

4. The shotgun shell carrier of claim 3, wherein said magazine follower is formed of plastic material.

5. The shotgun shell carrier of claim 4, said feeding lips are formed of spring steel.

6. The shotgun shell carrier of claim 5, wherein said housing includes count holes along each sidewall.

7. The shotgun shell carrier of claim 6, wherein said protrusions on the sidewalls comprise internally threaded metal inserts therein and knurled bolts having an aperture for receiving a cotter pin.

8. The shotgun shell carrier of claim 2, wherein said feeding lips are formed of spring steel.

9. The shotgun shell carrier of claim 8, wherein said housing includes count holes along each sidewall.

10. The shotgun shell carrier of claim 9, wherein said protrusions on the sidewalls comprises internally threaded metal inserts therein and knurled bolts having apertures for receiving cotter pins.

11. The shotgun shell carrier of claim 10, wherein rigid strips are secured to said protrusions by said knurled bolts.

12. The shotgun shell carrier of claim 11, wherein said strips include attaching clips.

13. The shotgun shell carrier of claim 10, wherein an X-shaped bracket and a pair of crossbars are secured in an hourglass configuration to said protrusions by said knurled bolts.

14. The shotgun shell carrier of claim 13 wherein a paddle is adjustably secured to said X-shaped bracket.

15. A shotgun shell carrier, comprising:

a general rectangular housing sized to receive between 5 and 25 shotgun rounds double stacked, said housing having a front wall, a back wall, two side walls, an open end and an end closed by a sliding door, wherein said housing is made of a durable high-strength composite plastic material;

spring structure positioned within said housing between said sliding door and a magazine follower;

elongated slot formed within said housing adjacent said open end for receiving and securing a pair of opposing feeding lips in said open end of said housing;

each feeding lip having curved spring fingers separated by a finger slot and a spring portion for cooperating with said elongated slot for receiving and securing said pair of opposing feeding lips;

each side wall having an extension portion extending beyond said open end of said housing with an internal recess extending from a point on the side wall adjacent said open end of said housing to a distal end of said sidewall, each extension portion further including a beveled opening having a diameter slightly greater than the diameter of a shotgun shell;

a blocking member pivotally mounted within each said internal recess, said blocking member including a paddle portion, a neck portion and a ring-shaped portion having a diameter greater than the diameter of shotgun shells, said ring-shaped portion having a foot positioned to interfere with movement of a shotgun shell from said feeding lips of said carrier, each blocking member being pivotally attached at said neck portion to an extension portion; and protrusions on said sidewalls for securing carrier attaching elements, said protrusions on the sidewalls of said housing having internally threaded metal inserts therein and knurled bolts having apertures for receiving cotter pins.

16. The shotgun shell carrier of claim 15, wherein rigid strips are secured to said protrusions by said knurled bolts.

17. The shotgun shell carrier of claim 16, wherein said strips include attaching clips.

18. The shotgun shell carrier of claim 15, wherein an X-shaped bracket and a pair of crossbars are secured in an hourglass configuration to said protrusions by said knurled bolts.

19. The shotgun shell carrier of claim 18, wherein a paddle is adjustably secured to said X-shaped bracket.

20. The shotgun shell carrier according to claim 15, wherein said elongated slots for receiving and securing a pair of opposing feeding lips in said open end of said housing comprises an elongated slot in said front wall and said back wall.

* * * * *